US007011608B2

(12) United States Patent
Spencer

(10) Patent No.: US 7,011,608 B2
(45) Date of Patent: Mar. 14, 2006

(54) PNEUMATIC POGO STICK

(76) Inventor: Bruce L. Spencer, 23591 Avenida Topange, Mission Viejo, CA (US) 92691

( * ) Notice: Subject to any disclaimer, the term of this patent is extended or adjusted under 35 U.S.C. 154(b) by 258 days.

(21) Appl. No.: 10/278,075

(22) Filed: Oct. 21, 2002

(65) Prior Publication Data

US 2003/0092537 A1 May 15, 2003

Related U.S. Application Data

(60) Provisional application No. 60/335,524, filed on Oct. 19, 2001.

(51) Int. Cl.
*A63B 25/08* (2006.01)
*A63B 21/008* (2006.01)

(52) U.S. Cl. ..... 482/77; 482/112

(58) Field of Classification Search ..... 482/75–77, 482/112–113; D21/413; 280/87.05, 73–74, 280/51

See application file for complete search history.

(56) References Cited

U.S. PATENT DOCUMENTS

| | | | |
|---|---|---|---|
| 3,495,671 | A | 2/1970 | Samiran |
| 3,627,314 | A | 12/1971 | Brown |
| 3,731,920 | A | 5/1973 | Matsuda |
| 3,765,673 | A | 10/1973 | Daw |
| 3,773,320 | A | 11/1973 | Samiran et al. |
| 3,782,352 | A | 1/1974 | Sparber |
| 3,853,195 | A | 12/1974 | Rasanen |
| 3,855,979 | A | 12/1974 | Ottaway |
| 3,977,094 | A | 8/1976 | Rivera et al. |
| 4,243,218 | A | 1/1981 | DeSousa |
| D263,485 | S | 3/1982 | Rudell et al. |

(Continued)

FOREIGN PATENT DOCUMENTS

| | | | |
|---|---|---|---|
| GB | 2 226 769 | A | 11/1990 |

(Continued)

*Primary Examiner*—Jerome W. Donnelly
*Assistant Examiner*—Fenn C. Mathew
(74) *Attorney, Agent, or Firm*—Knobbe Martens Olson & Bear LLP

(57) ABSTRACT

A pneumatic pogo stick is comprised of an elongate cylindrical housing which forms a cylinder. The housing is formed from a clear polycarbonate plastic. A top cap is attached to one end of the housing to form the top of an air chamber. A plastic piston, slidable within the cylinder, forms the bottom of the air chamber. An elongate shaft is coupled to the bottom of the piston and is moveable therewith, extending from the distal end of said housing as the piston moves within the cylinder. A bottom bracket assembly is attached to the bottom of the housing and a bushing for maintaining the lateral position of the shaft relative to the housing is attached to the bottom bracket assembly. The bushing prevents the shaft from rotating relative to the housing. User foot supports are also attached to the bottom bracket for supporting the feet of the user and handle bars are attached to the top cap for grasping with the hands of a user.

13 Claims, 9 Drawing Sheets

U.S. PATENT DOCUMENTS

| | | | | |
|---|---|---|---|---|
| 4,632,371 | A | 12/1986 | Wirges et al. | |
| 4,902,004 | A | 2/1990 | Gerlach | |
| 5,087,037 | A * | 2/1992 | Morrow | 482/33 |
| 5,292,295 | A | 3/1994 | Gerlach | |
| 6,126,578 | A | 10/2000 | Lapointe | |
| 6,168,555 | B1 | 1/2001 | Fetterleigh et al. | |
| 6,503,177 | B1 * | 1/2003 | Herman | 482/77 |
| 6,558,265 | B1 * | 5/2003 | Middleton | 472/135 |
| 6,619,634 | B1 * | 9/2003 | Chen et al. | 267/64.17 |
| 6,694,861 | B1 * | 2/2004 | Glasson | 92/5 R |
| 6,726,603 | B1 * | 4/2004 | Beaute et al. | 482/77 |
| 6,827,673 | B1 * | 12/2004 | Chen et al. | 482/77 |

FOREIGN PATENT DOCUMENTS

| | | |
|---|---|---|
| WO | WO 99/61111 | 12/1999 |

* cited by examiner

PNEUMATIC POGO STICK

CROSS-REFERENCE TO RELATED APPLICATION

The present application claims priority to U.S. Provisional Patent Application Ser. No. 60/335,524 filed on Oct. 19, 2001.

FIELD OF THE INVENTION

The present invention related generally to a pogo stick, and more specifically, to a pneumatic pogo stick that utilizes lightweight and durable materials to maximize the performance and reliability of a pneumatic pogo stick.

BACKGROUND OF THE INVENTION

A conventional pogo stick utilizes a coil spring within a hollow tube housing to create an upward force when compressed by a user to propel the user in an upward direction. In order to get more lift than can be provided with a coil spring and without increasing the weight of the pogo stick itself, it has been recognized in the art that an air filled cylinder/piston arrangement can produce increased propulsion or lift for the same length of stroke. Some have gone so far as incorporating engine power in order to increase lift and provide a powered jumping stick.

Various attempts have been made in the art to provide pneumatic pogo sticks. For example, PCT Application WO9961111 discloses an air-type pogo stick which includes an air cylinder to which foot-boards are attached in a body. The air cylinder has a valve through which a user can regulate air. The pogo stick is simultaneously worked by both air pressure power and vacuum power created in the upper and lower part of the piston in the cylinder respectively when exerted by an outside force. Such a pogo stick, however, has many shortcomings in both construction and functionality and fails to address any of the problems encountered when attempting to use compressed air as a spring, such as smoothness of rebound.

A similar dual chamber jumping device is disclosed in U.S. Pat. No. 4,632,371 in which a working cylinder provides a working chamber containing a mass of gas. A gas exchange chamber is fixed with respect to the working cylinder. An exchange passage connects the working chamber and the gas chamber. A gas exchange valve is provided in the exchange passage. An exchange operating handle is provide separate from the plunger. Such a device is overly complicated and requires multiple complex parts for assembly and operation. Furthermore, such a device is relatively heavy and therefor decreases the lift capabilities of such a device.

Thus, it would be advantageous to provide a pneumatic pogo stick that is of relatively lightweight construction, durable, safe, simple, and reliable in operation.

It would be a further advantage of the present invention to provide a pneumatic pogo stick that provides a relatively smooth ride especially at the bottom of the compression cycle to prevent jarring of the rider.

It would be a further advantage of the present invention to provide a pneumatic pogo stick that allows a user to view the internal components of the pogo stick for verification of the integrity of the working parts.

It would be yet a further advantage of the present invention to provide a pneumatic pogo stick that is capable of smoothly propelling a user several feet off the ground.

It would be still a further advantage of the present invention to provide a pneumatic pogo stick that is easier to maneuver than other pogo sticks known in the art and that can be easily adjusted to accommodate users of various weights and abilities.

These and other advantages will become apparent from a reading of the following summary of the invention and description of the illustrated embodiments in accordance with the principles of the present invention.

SUMMARY OF THE INVENTION

The present invention comprises a pogo stick that utilizes a pneumatic spring. The pogo stick of the present invention includes a piston/cylinder with user graspable handles attached or coupled relative to the top of the cylinder and an elongate shaft attached to the bottom of the piston. When a user compresses air in the cylinder by jumping on foot supports attached or coupled relative thereto, the piston compresses air inside the cylinder. Thus, stepping or jumping on the foot supports pushes the piston upward, compressing the air inside the cylinder. This compressed air acts like a spring creating a force on the piston thus forcing the piston and the attached shaft away from the handles, which in turn propels the cylinder, the foot supports attached thereto, and, ultimately, the user.

Such a pneumatic pogo stick has a potentially higher power to weight ratio than a comparable coil spring pogo stick. Moreover, since the air pressure within the cylinder can be adjusted to accommodate the weight of a particular rider and because the compressed column of air within the cylinder can create tremendous force on the piston, the pneumatic pogo stick of the present invention can be configured to propel an adult user six feet or more into the air.

The pogo stick, in accordance with the principles of the present invention, includes an outer housing which forms the cylinder. The piston is fitted within the housing and sealed relative to the inside surface of the housing as with a U-cup seal. The piston is thus slidable within the housing to form the piston cylinder arrangement of the present invention. The housing or cylinder is formed from a plastic tube, such as poly vinyl chloride (PVC) or polycarbonate. Such materials exhibit properties of significant tensile and shear strength while being lightweight and capable of exhibiting such properties when formed into a thin-walled structure. The top of the cylinder is sealed to allow the piston to compress an amount of air between the top of the piston and the top of the cylinder.

In one embodiment of the present invention, the top of the cylinder is sealed with a top cap member coupled to the top portion of the cylinder. Because of the extreme pressures within the cylinder that may be generated by a user during use of the device, the top cap is configured to be attached in a manner that securely secures the top cap to the top of the cylinder.

Handle bars or other gripping members are secured at or near the top portion of the cylinder as by coupling to the top cap. Foot support structure such as foot pegs are attached at or near the bottom of the cylinder. A shaft fixedly attached to the bottom of the piston extends out the bottom of the cylinder. A rubber or urethane pad is attached to the bottom of the shaft. As a user jumps on the pogo stick of the present invention, the impact between the ground and the bottom of the shaft forces the piston toward the top of the cylinder thus increasing the air pressure within the cylinder. As the air pressure within the cylinder increases, the user decelerates until the force created by the compressed air equals the force applied by the user to the foot pedals and handle bars. Once the user's downward momentum is stopped, the force generated by the compressed air between the piston and the top of the cylinder reverses the direction of the momentum of the user. The compressed air then forces the piston toward the bottom of the cylinder, rapidly extending the shaft out the bottom of the cylinder and propelling the user and the pogo stick.

While various pneumatic pogo sticks have been attempted in the art, the pogo stick of the present invention incorporates various novel features, not the least of which is the use of a plastic material, such as a PVC or polycarbonate tube, or other plastic materials known in the art that are strong, durable and resilient. Such strength, durability and resiliency allow the cylinder to withstand the rigors of use without significant damage or failure, including, but not limited to, severe side impact and high internal pressure. Polycarbonate is a good choice because it can be formed into the desired shape, has a relatively high tensile strength and is light weight. Furthermore polycarbonate can be manufactured in a variety of colors including clear and can be easily extruded into the desired form. Moreover, such plastic materials can be made to be clear or at least of limited opacity so as to allow a user to view the internal workings of the pogo stick, specifically the piston, seals and other internal components to evaluate their integrity without having to disassemble the device. In addition, the use of a clear material for the housing allows the user to easily evaluate the condition of the inside surface of the cylinder. Such evaluation would be more difficult if the cylinder were formed from an opaque material. Those of skill in the art will appreciate that other materials may also be employed such as various forms of cellulose acetate butyrate, and carbon fiber/resin/epoxy combinations.

The pogo stick of the present invention is designed to be strong and durable while minimizing weight. In addition, it is designed to be maneuverable and controllable during use. One feature that improves maneuverability and control is the use of a non-circular slider shaft engaging with a non-circular aperture at the bottom of the cylinder to limit and/or prevent rotation of the slider shaft relative to the cylinder. In one embodiment, the slider shaft is comprised of a hollow square tube. In any event, the slider shaft may comprise various other non-circular cross-sectional shapes. The square tube engages with a bottom assembly which is attached to the bottom portion of the cylinder and includes a bushing that may be formed from strong, low-friction plastic, having a square hole formed therein for slidably receiving the slider shaft while limiting rotation of the slider shaft relative thereto. The engagement of the square slider shaft with the bushing substantially prevents the slider shaft and thus the piston from rotating relative to the cylinder, providing greater control of the pogo stick by the user and preventing lateral wear of the piston seal that may otherwise be caused by rotational movement of the piston relative to the cylinder.

Like the outer housing, the piston body itself may be made from a plastic material such as an ultra high molecular weight polyethylene (UHMWPE) or Delrin. Such materials are durable and provide a surface having a low coefficient of friction so as to reduce the amount of wear on the inside surface of the cylinder 12 during use. By using the similar types of material for the cylinder and piston, wear is significantly reduced between the two components.

In the case where wear or damage does occur, the piston of the present invention is configured to be easily replaced. In order to replace the piston, the bottom assembly, which may be bolted with threaded fasteners to the bottom portion of the cylinder, is removed. If necessary, the foot supports are also removed. The piston with its attached slider shaft can then be removed from the cylinder. The piston and slider shaft can then be disassembled so that the piston can be replaced. Other components such as the slider shaft and bottom bushing can also be replaced in a similar manner.

In order to maintain air pressure within the cylinder during use, the piston is sealed relative to the inside surface of the cylinder. If even a small amount of air were to escape from between the cylinder and the piston during operation, the pogo stick would eventually lose its ability to propel the user. In one embodiment, a U-cup seal is placed around the piston in a circumferential groove therein to form a seal between the piston and the cylinder.

As the user is propelled off the ground, the compressed air in the cylinder rapidly forces the piston to the bottom of the cylinder. The impact between the bottom of the cylinder and an abutment at the base of the cylinder is softened by use of a shock absorbing material, such as an elastomer pad. The pad cushions the piston's impact at the bottom of its stroke. The shock absorbing pad may be doughnut shaped to fit around the slider shaft and may be attached to the top of the bushing.

In another embodiment, a coil spring or other shock absorber type structures and materials are utilized to reduce the impact between the piston and the bottom bushing. By preventing direct contact between the piston and the bottom assembly, the components will be protected from damage that may otherwise occur.

In another embodiment, because the motion of the piston creates a vacuum below it on its upward stroke, it is highly likely that dust and dirt would be drawn into the cylinder. A dust seal around the slider shaft may be provided to allow air to flow into this space.

Likewise, a chamber or housing may be provided above the bottom assembly into which an oil/foam air filter is inserted. The filter material is formed to fit snugly around the slider shaft. The filter effectively prevents dust and dirt from entering the cylinder and significantly reduces excess wear and damage that might otherwise occur.

The distal end of the slider shaft is provided with a pad, such as a urethane or rubber pad attached to the bottom of the slider shaft. The pad softens the initial impact of the end of the slider shaft with the ground to provide a smoother and less jarring ride for the user. In addition, the pad provides a ground gripping structure that allows the user to apply side forces to the pogo stick without the slider shaft slipping from beneath the user. Thus, the pad acts as both a cushion as the pogo stick hits the ground and a ground gripping member to allow the user to increase maneuverability of the pogo stick without losing control.

A bottom assembly is attached to the bottom of the cylinder. This assembly provides an abutment structure at the distal end of the cylinder for preventing the piston from exiting the cylinder. The bottom assembly also provides structure for secure attachment of user foot supports.

In one embodiment, the top cap is provided with an air valve for adding air to and releasing air from the air cylinder. The air valve allows the cylinder to be pre-pressurized before use and to customize the air pressure to the user's desires. Thus, for example, for a heavier user, more air can be added before use to provide sufficient "bounce" of the pogo stick during use for the particular user. In addition, the air within the cylinder can be selectively released if it is determined that less air is desired.

In order to provide a pogo stick that is comfortable to operate by an average user while providing the desired bounce in the device, the dimensions of the various components of the pogo stick of the present invention have been optimized. That is, for each rider there is a preferred distance between the hand grips and the foot pegs for most comfortable operation of the pogo stick. There is an important relationship between the above mentioned external dimension and the maximum piston stroke length. For example, for an average adult rider, a stroke length of the piston of approximately 14 inches to 20 inches is desired. Longer stroke lengths mean that the cylinder of the pogo stick must also be longer causing the pogo stick to become longer and more awkward to operate.

The maximum compression ratio of the air cylinder of the pogo stick also helps to add to or detract from the comfort of use of the pogo stick. For more comfortable operation, the air cylinder maximum compression ratios are from approximately 2.5:1 to 4.5:1. This range helps to provide smooth jumping and landing. Furthermore, it prevents a "hammering" effect on the user, caused when the air pressure inside the air chamber ramps up rapidly due to too high of a maximum compression ratio. The desired maximum compression ratio is achieved by either increasing the length of the air cylinder or decreasing the piston stroke. The ratio of piston stroke to cylinder length of the pogo stick of the present invention is such that this "hammering" effect is eliminated.

In one embodiment, the foot pedals include "grinding" features on their bottom sides. Such "grinder pedals" allow the user to do tricks that involve sliding on the pedals down various structures such as metal rails. These pedals may be formed from metal with plastic inserts on the bottom surface in order to decrease wear and friction when sliding.

In another embodiment, a user controllable slider shaft brake are incorporated. Such a brake allows the user to stop the motion of the slider shaft by applying a clamping or gripping force to the slider shaft. In one embodiment, a lever, such as a brake lever found on a motorcycle is provided on the handlebars for actuating the brake. The brake allows the user to prevent the slider shaft from moving relative to the cylinder.

Thus, the pogo stick of the present invention has significantly more power than a conventional spring-type pogo stick, is more maneuverable, allowing the user to perform various tricks, is durable and relatively light weight, and is configured to provide a smooth and non-jarring ride for a user of practically any size and weight.

BRIEF DESCRIPTION OF THE DRAWINGS

The foregoing summary, as well as the following detailed description of the illustrated embodiments is better understood when read in conjunction with the appended drawings. For the purpose of illustrating the invention, there is shown in the drawings several exemplary embodiments which illustrate what is currently considered to be the best mode for carrying out the invention, it being understood, however, that the invention is not limited to the specific methods and instruments disclosed. In the drawings.

DETAILED DESCRIPTION OF THE INVENTION

Figure 1:
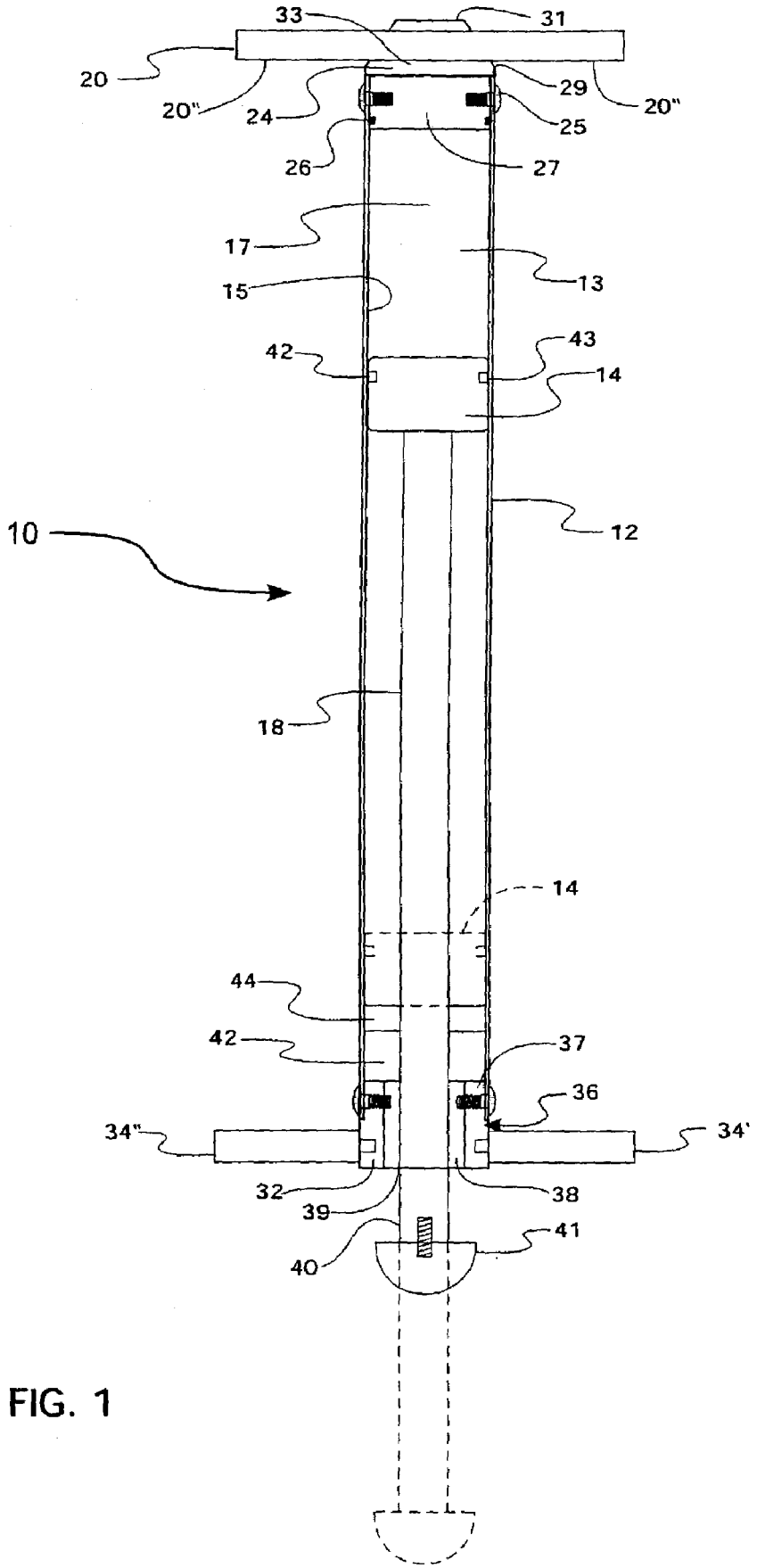
FIG. 1 is a cross-sectional side view of a first embodiment of a pneumatic pogo stick in accordance with the principles of the present invention.
Figure 2A:
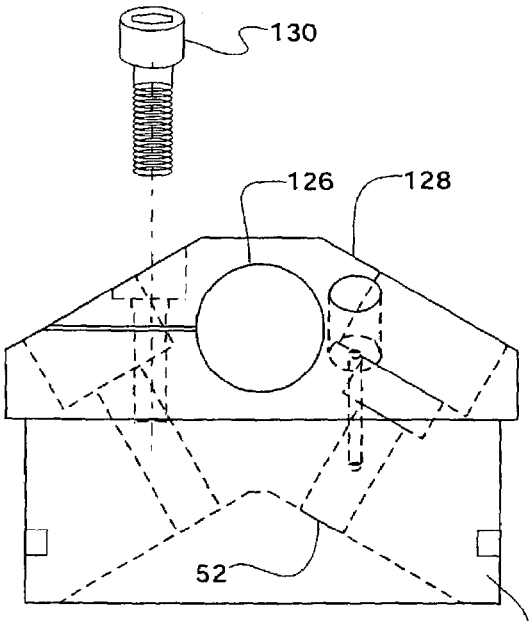
FIGS. 2A, 2B, 2C and 2D show first and second side views and first and second top views, respectively, of a first embodiment of a top cap in accordance with the principles of the present invention.
Figure 2B:
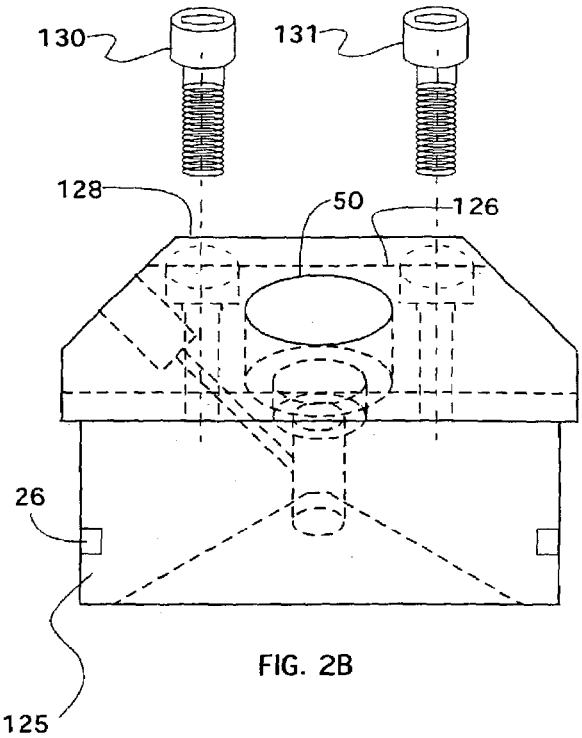
Figure 2C:
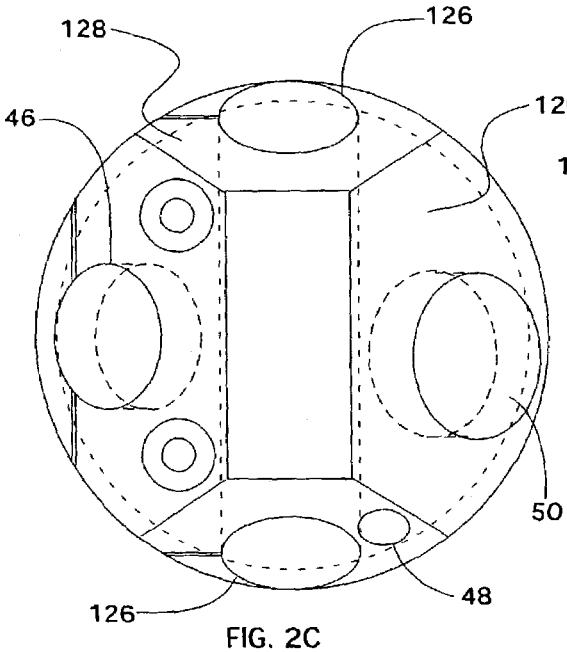
Figure 2D:
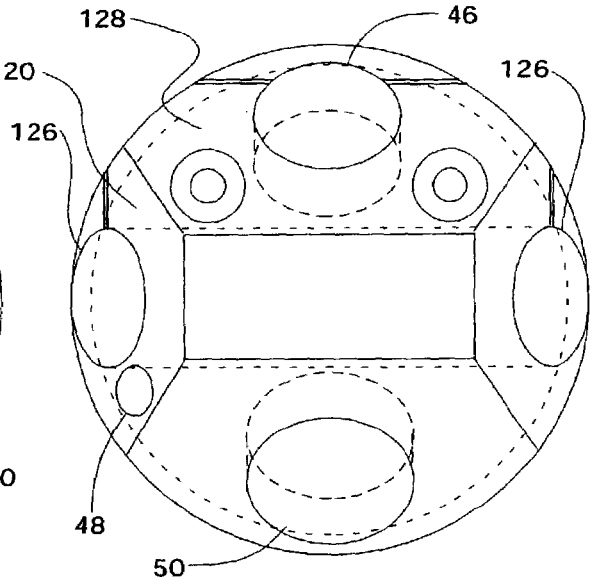

FIG. 1 illustrates a first embodiment of a pneumatic pogo stick, generally indicated at 10, in accordance with the principles of the present invention. The pogo stick 10 is comprised of a plastic tube 12 which forms an outside housing to which various other components of the device are attached and a cylinder portion 15 of a piston 14/cylinder 15 arrangement. Plastics such as PVC or polycarbonate are preferable over other materials including steel and aluminum because they are strong, lightweight, resilient, inexpensive, and dent resistant. An alternate material that could be used for the cylinder 12 is cellulose acetate butyrate. Such plastic materials are preferred since metals such as aluminum or steel, if dented, may cause the pogo stick to leak air between the cylinder 15 and piston 14 during use or partially or fully obstruct movement of the piston 14 relative to the cylinder 15 so that the device 10 is no longer operable. Thus, despite side impacts, the cylinder 15 must remain sufficiently round in order for the piston 14 to be able to smoothly travel through it. Because of the nature of use of such an extreme pogo stick, forming the housing 12 from an easily deformable, less resilient material may limit the life of the pogo stick.

The pogo stick 10 of the present invention is configured to accommodate various sizes and weights of users and to propel the user several feet in the air. For example, assuming that the maximum weight of a user is about 250 pounds and that the maximum "g" load that could be exerted would be about 4 g's (A "g" being a measurement of acceleration where 1 g equals the acceleration of gravity). For a 250 lb. user, 4 g's results in a 1000 lb. force or maximum load. To keep the maximum operating air pressure within the cylinder 15 at about 150 psi, the top surface of the piston 14 would have an area of approximately 7 sq. in. or larger (1000 lbs divided by 150 psi. equates to 6.67 sq. in.). A 3 inch diameter cylinder 12 has an area of approximately 7 sq. in. In order to provide a safety factor, the cylinder 15 may be provided with a 3.25 inch inner diameter. Using a 3.25 inch inner diameter cylinder 15 provides a piston 14 area of approximately 8 sq. in. For a smaller user, such as a child, the diameter of the cylinder 15 may be two inches or less. Likewise, for more extreme riding and or larger adult riders, the diameter of the cylinder 15 may be four inches or more.

The thickness of the walls of the housing 12 is dependent on the type of material being used for the housing 12. The housing 12 must be able to at least withstand the 150 psi internal pressure, as well as the all of the various impacts and stresses that the pogo stick 10 experiences during use. For a polyethylene or polycarbonate housing 12, an optimal wall thickness would be about ⅛ inch. Another factor in constructing the housing 12 is to determine an appropriate length. In order to accommodate an average user, the length of the housing 12 should not be too long or too short. For a rider who is approximately 5 ft. 10 inches tall, the length from foot supports 34' and 34" to a hand grip member 20 is about 30–34 inches. If the housing 12 is to be fitted between the foot supports 34' and 34" and the hand grip member 20, the length of the housing 12 should be about 32 inches long. This length of the housing 12 allows the hand grip member 20 to be positioned proximate the top of the housing 12 and the foot supports 34' and 34" positioned near the bottom of the housing 12. In addition, such distance between the foot supports 34' and 34" and the hand grip member 20 provides a comfortable position for the user when riding the pogo stick 10. While it is contemplated that longer or shorter lengths of the housing 12 could be utilized, the use of a significantly longer housing 12 may prevent the user from leaning over the top of the handle grip member 20 to use his/her upper body weight to apply force to the pogo stick 10 or may extend a slider shaft 18 below the foot supports 34' and 34" a distance that makes it difficult for the user to initially get on the pogo stick 10.

It is further contemplated that the foot supports could be configured to be vertically adjustable relative to the longitudinal axis of the pogo stick 10. That is, to better accommodate riders of various heights, the foot supports 34' and 34" could be indirectly coupled to the bottom bracket 32. For example, an outer sleeve or bracket assembly (not shown) attached to the bottom bracket 32 may provide multiple attachment points along a length thereof for attachment of the foot supports 34' and 34" at discrete locations relative to the length of the housing 12. Likewise, a riser (not shown) could be attached to the top cap to which the handle bars could be attached to increase the distance between the top cap and the foot supports. As such, the distance between the foot supports 34' and 34" and the handle grip member 20 may be increased or decreased depending upon the height of the user and the user's comfortable riding position. Likewise, the handle grip member 20, which is illustrated as being an elongate, generally straight length of material may be replaced with a handle member (not shown) that is configured more similarly to those found on bicycles. That is, the handle member could have a curved or arched center portion with raised gripping portions that extend above the point of attachment to the top of the pogo stick 10. Such a handle bar arrangement could thus be utilized to increase the effective distance between the handle grip portion and the foot supports or pedals 34' and 34" to accommodate taller riders.

Maximum compression ratio is the ratio of the volume of the air before it is compressed, divided by the volume of the air after it is fully compressed. This maximum compression ratio is, therefore, a function of the maximum stroke length and the length of the dead space that is within the cylinder 12. FIG. 1 shows the piston 14 at the top of its maximum stroke and (in dashed lines) at the bottom of its stroke. The maximum length of stroke is in part dependent upon the total length of the cylinder 15. To a large extent, the desired length of the pogo stick 10 is what determines the length of the cylinder 12, which in turn effects the diameter of the cylinder 15 to provide the desired riding characteristics of the present invention.

The diameter of the cylinder 12 is based on ease of use, or more specifically, smoothness of ride and the desired feel of "springiness" generated by the compression of air in the cylinder 15. The larger the diameter of the cylinder 15, the lower the operating pressures will be. Thus, it is desirable to make the diameter of the cylinder 15 as large as possible without making the pogo stick 10 too awkward to operate.

As the maximum compression ratio is dependent on the stroke length, the length of the slider shaft 18, which is attached to the piston 14 and extends from the housing 12, must be sufficient to achieve the desired maximum compression ratios. While the maximum possible compression occurs when the shaft 18 is forced as far into the housing 12 as possible, the insertion of the shaft 18 is limited by the amount of compression generated by the particular user. Thus, the shaft 18 should be sufficiently short to allow the shaft 18 to travel into the housing 12 without allowing the piston 14 to contact a top cap 24, which defines the top of the cylinder 15. The distance between the top cap 24 and the piston 14 at the top of its maximum stroke is the "dead space" 13. The smaller the dead space 13, the higher the maximum compression ratio.

The length of the shaft 18 should not be so long that it causes too high of a maximum compression ratio or that a user cannot easily reach the foot supports 34' and 34" when attempting to get onto the pogo stick 10. Too long of a slider shaft 18 also makes the pogo stick 10 difficult to control placing the center of gravity of the user too high off the ground.

In this embodiment, the top of the cylinder 12 is sealed by the cap 24 that is bolted or otherwise mechanically, adhesively or chemically attached as by welding proximate the top 25 of the housing 12. The cap 24 has an insertion portion 27 that fits tightly inside the housing 12. The cap 24 also has a lip 29 that is the approximately the same thickness as the housing wall. This lip 29 allows the cap 24 to be properly inserted into the housing 12 during assembly as the lip 29 abuts with the top of the housing 12 when the cap 24 is fully inserted therein. The top cap 24 of the housing 12 must be sufficiently secured within the housing 12 so as to be able to withstand the pressure from the compressed air in the cylinder 15 when it is compressed by the piston 14. An 'O' ring 26 in the insertion portion 27 of the top cap 24 creates an airtight seal between the housing 12 and the top cap 24, with the top cap 24 and piston 14 forming a compression chamber 17.

The handle bar 20 of the pogo stick 10 is attached by a clamp 31 that is incorporated into the top cap 24. The handle bar 20 consists of an aluminum or stainless steel tube with hand grips 20' and 20" on both ends that extend beyond the clamp 31 of the top cap 24. The base portion 33 of the top cap 24 which includes the insertion portion 27 is bolted as with threaded fasteners as shown through the wall of the housing 12 and into the insertion portion 27. While only two threaded fasteners or bolts are shown, there are actually a plurality of such fasteners radially disposed around the housing 12 to provide multiple points of attachment between the housing 12 and the top cap 24 to ensure that the top cap 24 cannot dislodge from the housing 12.

At the distal end of the housing 12 is the bottom assembly, generally indicated at 36. The bottom assembly 36 provides four basic functions. First, the bottom assembly 36 provides an abutment for preventing the piston 14 from exiting the distal end of the housing 12, as when the piston 14 is in the position shown in dashed lines. Second, the bottom assembly 36 provides structure for attaching the foot supports 34' and 34" relative to the housing 12. Third, the bottom assembly 36 provides a bearing surface for maintaining proper longitudinal alignment of the slider shaft 18 as the piston 14 moves within the cylinder 15. Fourth, the bottom assembly provides an air filtration system to filter out dust and other particulates from entering the cylinder 15 through the distal end of the housing 12. Such contaminates may otherwise form abrasives in any lubricant utilized to reduce friction between the piston 14 and cylinder 15 and thus may effect the operation of the piston/cylinder arrangement of the present invention.

The bottom assembly 36 includes a bottom bracket 32 having an insertion portion 37 similar to that of the top cap 24. The bottom bracket 36, however, has a hollow cylinder configuration for receiving and maintaining a slider shaft bushing 38. The bushing 38 defines a central aperture 39 for receiving the slider shaft 18 and defines a guide for the slider shaft 18 as it moves into and out of the device. Moreover, because the slider shaft 18 has a non-circular cross-section, forming the aperture 39 of a similar shape will prevent the slider shaft 18 from rotating relative to the bushing 38. Furthermore, because the bottom bracket 32, bushing 38 and housing 12 are bolted together with a plurality of threaded fasteners, as shown, the bushing 38 is prevented from rotating relative to the housing 12. It is desirable, in accordance with the principles of the present invention, to prevent any substantial rotation of the slider shaft 18 relative to the housing 12 as the distal end of the slider shaft 40 carries the bounce pad 41. The bounce pad 41 is the primary contact the user has between the pogo stick 10 and the ground or riding surface. By preventing rotation of the slider shaft 18, and thus the bounce pad 41, relative to the housing 12 and thus the handle bar 20, the rider will have more control over his or her movement by eliminating a rotational degree of freedom that would otherwise be present if the slider shaft were circular in cross-section. In addition, prevention of rotation of the slider shaft 18, which is coupled to the piston 14, prevents rotation of the piston 14 relative to the cylinder 15. Such rotational movement of the piston 14 relative to the cylinder 15 may otherwise cause additional wear between the piston and cylinder that would decrease the life of the device 10.

As discussed, the engagement of the external features of the slider shaft 18 with the bushing 38 substantially prevents rotation of the shaft 18. In addition, the bushing 38 is fixedly mounted relative to the housing 12 so as to prevent rotation of the bushing 38 relative to the cylinder 12. This may be accomplished by bolting the bushing 38 into the aluminum sleeve of the bottom assembly. Another means of securing the bushing 38 to the bottom assembly may be to provide external threads on an exterior surface of the bushing 38 and internal threads on an interior surface of the aluminum sleeve. The bushing 38 could then be threaded into the sleeve and, if necessary, pinned in place. The bushing 38 is formed from a material that has a relatively low coefficient of friction and that is resistant to wear. By having a relatively low coefficient of friction, the slider shaft 18 can easily glide or slide through the bushing 38. In addition, as previously discussed, the bushing 38 keeps the slider shaft 18 from rotating, and as such there may be many instances during use in which the slider shaft 18 is applying significant side lateral force to the surface of the bushing 38. If the slider shaft 18 were to significantly grind against the bushing 38, the bushing 38 would wear over time, increasing the size of the slider hole therein such that the slider shaft 18 would be able to move laterally relative to the bushing 38. By providing a low friction surface and being formed from a low wear material, the life of the bushing 38 will be significantly increased requiring less frequent replacement, if any.

The foot supports 34' and 34" are fastened to the bottom bracket 32 as with elongate bolt members.

Positioned on the top of the bottom bracket 32 and bushing 38 is a doughnut shaped air filter 42. The air filter 42 may be formed from any fibrous material such as a felt-type pad that is capable of trapping dirt and dust entering the housing 12 through the aperture 39 of the busing 38. On top of the air filter 42 is a shock absorbing pad 44, such as an elastomer pad, of a similar doughnut shape for receiving the slider shaft therethrough. A coil spring or other shock absorber type structures and materials may also be employed. By preventing direct contact between the piston 14 and the bottom assembly, the components will be protected from damage that would otherwise occur. The filter 42 and pad 44 become sandwiched between the bottom surface of the piston 14 and the top of the bottom bracket 32 and bushing 38 when the piston 14 is at the bottom of its stroke, as shown in dashed lines. The pad 44 thus helps absorb the impact between the piston and the bottom assembly 36 to prevent damage to the various assemblies and provide a more comfortable feel to the pogo stick 10.

As discussed, the air is compressed in the cylinder 15 as the piston 14 moves toward the top cap 24. The piston 14 is cylindrically shaped and slightly smaller than the inside diameter of the cylinder 15. The piston 14 may be formed from plastics such as Ultra High Molecular Weight Polyethylene or Delrin. Such materials have relatively low coefficients of friction, high corrosion resistance, and good durability. The plastic on plastic combination of the piston 14 and the cylinder 15 creates a smoothly sliding interface allowing the piston 14 to slide along the cylinder 15 without significant wear of either component. It is also necessary to lubricate the inside of the cylinder 15 to reduce wear and to help seal the piston 14 relative to the cylinder 15.

The piston 14 has a circumferential groove 42 formed in its outer surface to hold a U-cup seal 43. The seal 43 can be made of Buna-N rubber, or other materials known in the art, and creates an airtight seal between the edges of the piston 14 and the walls of the cylinder 15. The seal 42 allows the piston 14 to compress the air in the cylinder 15 against the top cap 24. As previously mentioned, a lubricant helps to form an airtight seal between the seal 43 and the cylinder 15.

The piston 14 of the present invention is configured to be easily replaceable, as may be desirable if it becomes damaged or excessively worn. In order to replace the piston 14, the bottom assembly, which is bolted with threaded fasteners to the bottom portion of the housing 12, is removed. If necessary, the foot supports are also removed. The piston 14 with its attached slider shaft 18 is then slid from the housing 12. The piston 14 and slider shaft 18 are then disassembled so that the piston 14 can be replaced. Other components such as the slider shaft 18 and bottom bushing 36 can be replaced in a similar manner. To reassemble the pogo stick, the slider shaft 18 and piston 14 are reinserted into the housing 12 and the bottom assembly and foot supports reattached.

In order to maintain air pressure within the cylinder 12 during use, the piston 14 is provided with a seal relative to the inside surface of the cylinder 15. As previously discussed, if air were to escape from the cylinder 12 during operation, the pogo stick would lose its ability to propel the user. Thus, a U-cup seal 43 provides a substantially airtight seal around the piston 14. With the seal 43 in place, a compression chamber 17 is created between the piston 14 and the top cap 24.

As the various components are configured to be relatively easily disassembled for replacement of parts if necessary and while the seal 43 is designed to be long wearing, it may also be replaced. The seal 43 is replaced in much the same manner that the piston 14 is replaced. As discussed herein, the piston 14 is removed from the housing 12. Once the piston 14 is outside of the housing 12, the old seal 43 is removed and a new seal then put in place. The piston 14 can then put back in the housing 12 as is done when replacing the piston 14. Materials for the seal 43 would include rubber, EPDM, Neoprene, Silicone, Viton, PTFE, and Polyurethane. It is preferable that any such seal 43 be long wearing, resistant to UV exposure, as the housing 12 may be a clear or only partially opaque material, and easily replaceable.

As the user bounces in an upward direction, the piston 14 moves toward the bottom of the cylinder 15. In one example, the piston 14 has a maximum stroke length of approximately 18 inches and there is a dead space of approximately 8 inches at maximum stroke. This creates a maximum compression ratio of 3.25:1 which provides a relatively smooth ride for the user. Since pressure increases inversely relative to volume, at higher maximum compression ratios, e.g. 8:1, the pressure increases rapidly as the piston 14 compresses the air into a much smaller space. The resulting load doubles in the last 2 inches of travel. The result is that the rapid increase in load at the top of the stroke has a "hammering" effect on the rider, with a great force being generated to reverse the travel of the piston 14 and rider over a very short distance. This reversing force acts abruptly over a very short distance and then deteriorates rapidly.

A cylinder having an inner diameter of 3 inches to 4 inches is optimal for an adult version of the pogo stick. If the inner diameter were significantly smaller, then the pressure within the air cylinder would have to be proportionately increased to maintain the spring force of the pogo stick. Such an increase in pressure can produce the undesired "hammering" effect as well as requiring other modifications to the device, such as thicker walled materials to form the cylinder, in order to accommodate such higher pressures.

The maximum stroke length is about 14 to 18 inches for a majority of users. A maximum stroke length of the piston 14 and slider shaft 18 greater than 20 inches would make the pogo stick more difficult to operate. In order to harness the pressure built up in the cylinder 15, the piston 15 is attached to the slider shaft 18. The slider shaft 18 is the telescoping part of the pogo stick and moves up and down along with the motion of the piston 14. The bottom of the piston 14 has a square hole formed therein as by molding or machining. The slider shaft 18 fits into this hole and then is bolted or otherwise attached to the piston 14 as with a shoulder bolt that runs across the diameter of the piston 14 and nyloc nut. Preferably, the slider shaft 18 is made out of Chrome Moly (4130) or stainless steel tubing having a substantially square or hexagon cross-section of approximately 1.25 inch. Such materials have high strength to weight ratios. The slider shaft 18 thus protrudes from the bottom of the piston 14 and extends through the bottom bracket assembly. The bounce pad 41 formed from a material such as urethane rubber is attached to the distal end of the slider shaft 18.

Thus, forcing the shaft 18 into the housing 12 causes the piston to compress air in the cylinder 15 to create an air spring. The higher the psi, the larger the return force of the shaft 18 and the higher the user will be propelled. In addition, the non-circular shape of the shaft 18 and its engagement with the bottom bracket bushing 38 allows the user to apply a torque to the pogo stick since the slider shaft 18 cannot rotate relative to the housing 12 of the pogo stick 10. This allows for more control by the user. If the user inputs a rotational motion to the pogo stick, the entire pogo stick will rotate allowing the user to perform various tricks that may otherwise be difficult if the shaft 18 were allowed to rotate relative to the cylinder 12.

FIGS. 2A, 2B 2C and 2D show a detailed view of one embodiment of a top cap, generally indicated at 124, in accordance with the principles of the present invention. The top cap 124 may be formed from aluminum or other suitable materials known in the art, such as a material similar to or the same as the material used for the housing. The top cap 24 consists of a cylindrical bottom insertion portion 125 with an O-ring groove 126 that plugs into and seals the top end of the housing. It is attached to the housing by use of a plurality of button head machine screws equally spaced around the circumference, for example eight. The handle bar is inserted into the circular aperture 126 in the upper portion of the top cap 124 and is held in place by means of an integral clamp 128 that is tightened by two cap screws 130 and 131. The handle bars are preferably formed of light-weight aluminum tubing, similar to that used for bicycle handlebars, or thin-wall stainless steel tubing. Such handle bars give the user significant control over the pogo stick during use. Also included in the top cap 124 is a pressure gauge 50, fill valve 48, check valve and bleed valve 46.

In order to increase the stiffness of the pogo stick, the cylinder may be pre-pressurized by pumping air into the compression chamber. Air is added to the cylinder through a valve 46, such as a typical tire valve stem, attached or coupled to the top cap 124 and in fluid communication with the compression chamber. Air may be added by a bike pump, air compressor, or other means, until the pressure inside the cylinder reaches a desired level. This pre-load serves to create a stiffer "spring" and allows the user to gain more height on his/her jumps. In addition, the pre-load also helps to decrease the possibility of the aforementioned "hammering" effect.

The air valve 46 allows adding air to and releasing air from the air cylinder. The air valve 46 allows the cylinder to be pressurized before use to customize the air pressure to the user's desires. Thus, for example, for a heavier user, more air can be added before use to provide sufficient "bounce" of the pogo stick during use for the particular user. In addition, the air within the cylinder can be selectively released if it is determined that less air is desired. This is preferably allowed by a user activated bleed valve 48 that is incorporated into or attached to or near the handle bars. Thus, excess air pressure within the cylinder can be selectively released "on the fly." This allows the user to reduce the "spring" of the pogo stick while in motion if it is determined that the cylinder is over pressurized.

The preferred embodiment of the pogo stick includes a pressure gauge 50 in the top cap, thus allowing the rider to observe the pressure within the cylinder 12. Air pressure within the cylinder 12 reaches the gauge 50 after passing through a check valve 52. This check valve 52 assures that the pressure gauge 50 is not subjected to continual increases and decreases in pressure as the rider bounces on the pogo stick. It also allows the rider to determine the maximum pressure attained while jumping. The aforementioned bleed valve 48 is situated so as to relieve the pressure between the check valve 52 and the pressure gauge 50.

Since the air is already under pressure, it does not compress as rapidly and provides a smoother ride. The ability to set the pressure in the cylinder also makes it so that the pogo stick can be used by people of different weights. It allows, in essence, the stiffness of the spring to be changed. A stiffer spring or more pre-load pressure will be used for heavier riders and less pre-load pressure will be used for lighter riders.

A desired pre-load for adult users may be in the range of 15–50 psi. Once the user is done with the pogo stick for the day, the bleed valve 48 can be used to release the air within the air chamber so that the slider shaft can be inserted into the cylinder for storage of the pogo stick thus decreasing the overall length of the device.

Figure 3:
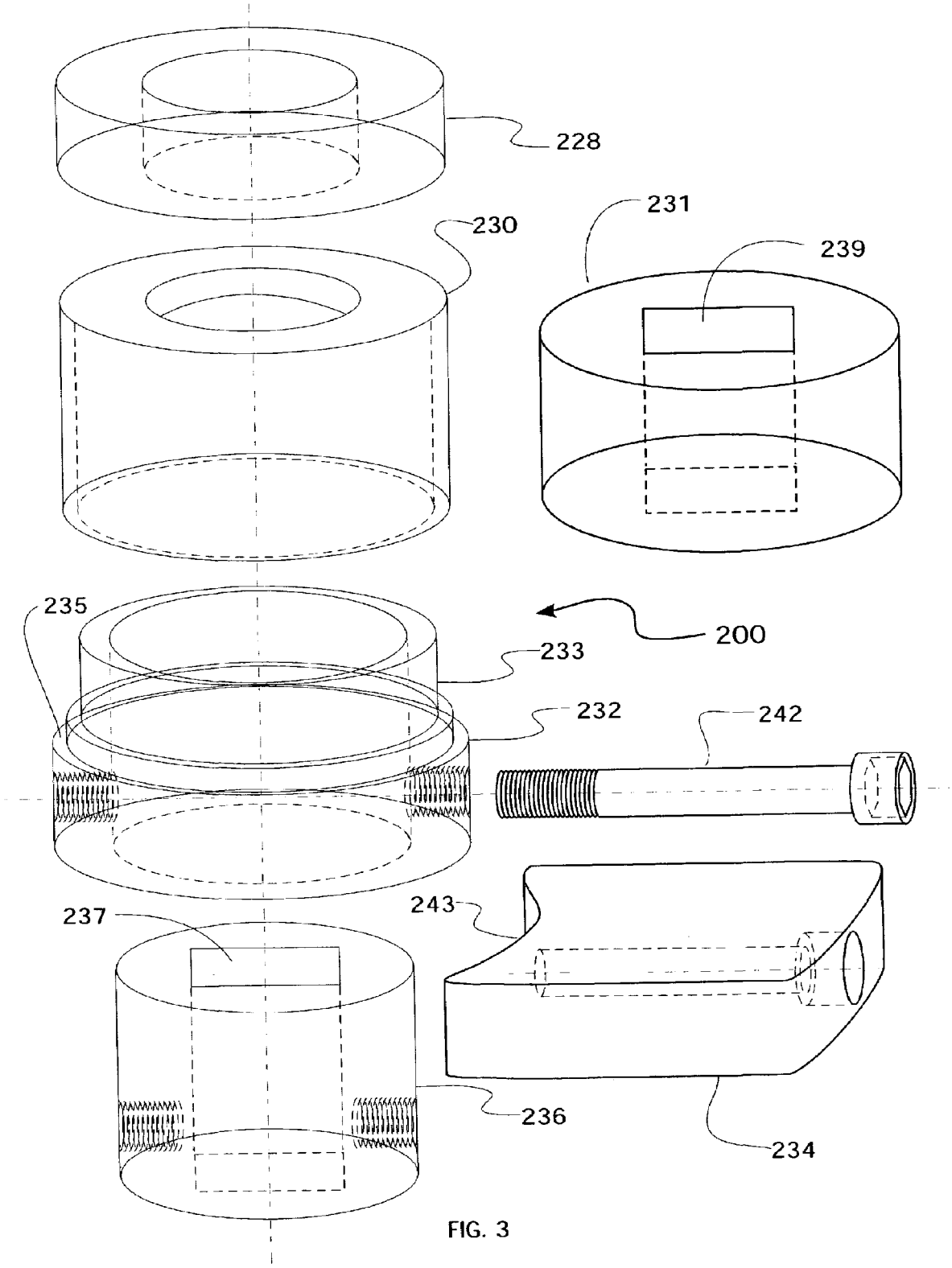
FIG. 3 is an exploded view of a first embodiment of a bottom bracket and foot peg in accordance with the principles of the present invention.

As shown in FIG. 3, a bottom bracket assembly, generally indicated at 200, includes a bottom bracket 232, formed from such material as aluminum. The bottom bracket 232 is a hollow cylindrical member with an insertion portion 233 configured to fit at least partially within the housing. A lip 235 on the bottom bracket 232 abuts against the bottom of the housing. The bottom bracket assembly 200 is bolted to the housing. The bottom bracket 232 is formed to receive a UHMW or other plastic bushing 236 therein. The bushing 236 fits relatively snugly within the bottom bracket 232 and is held in place by the foot peg bolts 242. The bushing 236 is secured to the bottom bracket 232 so as to prevent it from rotating and to carry the forces applied to it by the slider shaft. The bushing 236 has a hole 237 formed therein, in this case a substantially square hole, to receive the slider shaft in a manner that substantially prevents rotation of the slider shaft relative to the bushing 236. As the slider shaft slides against the bushing 236, the plastic on metal surface creates a very smooth bearing surface while minimizing wear of the slider shaft. While not necessary, if desired, a lubricant may be placed on the slider shaft.

Because the motion of the piston creates a vacuum below it on its upward stroke, it is highly likely that dust and dirt would be drawn into the cylinder. A dust seal around the slider shaft may prevent this occurrence. However, since the slider shaft is not round, an effective dust seal would be difficult to form. Therefore, a chamber or housing is provided above the bottom assembly into which an oil/foam air filter is inserted. The filter material is formed to fit snugly around the slider shaft. This effectively prevents dust and dirt from entering the cylinder and eliminates the excess wear and damage it might cause. Thus, an air filter housing 230 is coupled to the insertion portion 233 of the bottom bracket 232 and is configured for receiving an air filter insert 231 therein. The air filter insert 231 is formed from a cylindrical foam pad with a square hole 239 for receiving and fitting around the slider shaft. The air filter insert 231 is positioned within the air filter housing 230.

A shock absorbing pad 228 is positioned on top of the air filter housing 230 for absorbing the shock of the piston at the bottom of its stroke.

The foot pedals 234 are attached to the bottom bracket 232 and busing 236 with elongate bolts 242 that inserted through the foot pedals 234 and threaded through the bottom bracket 232 and busing 236. The inside surface 243 of the foot pedal 234 is contoured to substantially match the contour of the outside surface of the bottom bracket 232. As such, the foot pedal 234 is substantially prevented from rotating relative to the bottom bracket 232 for providing a stable foot support for the rider. The foot support or pedal 234 is bolted with bolt 242 into the bottom bracket 232. The pedal 234 is prevented from rotating relative to the bolt 242 by means of the concave edge on the attaching side. The foot pedal 234 can be made of a variety of materials and in various shapes and sizes to fit the particular needs of the user. Some may have concave arched undersides made of plastic for "grinding."

Also, by coupling the bushing 238 to the bottom bracket 232 with the bolt 242, the bushing 236 is prevented from rotating relative to the housing and thus can prevent rotation of the slider shaft relative thereto.

Figure 4:
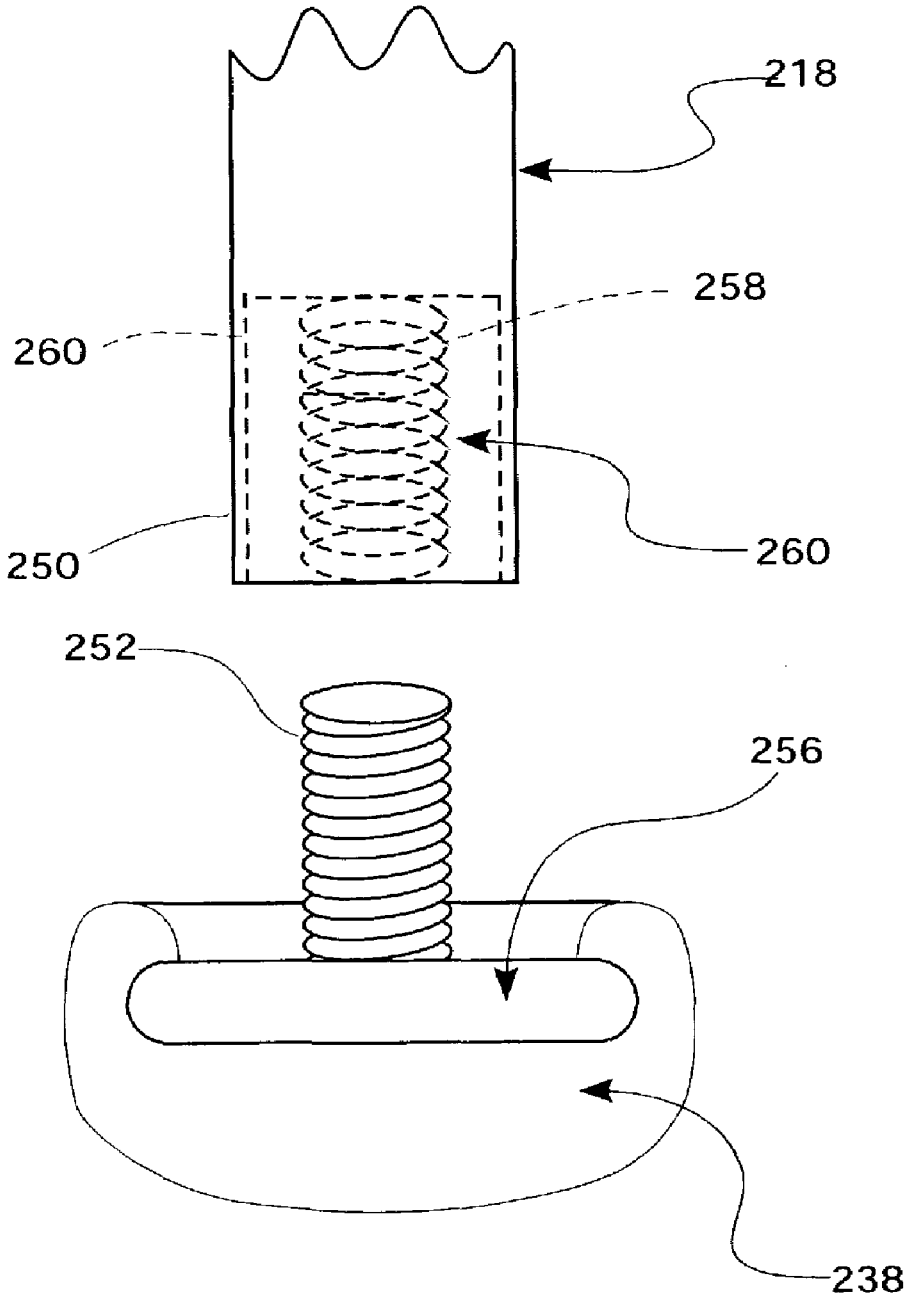
FIG. 4 is a partial cross-sectional side view of a first embodiment of the bounce pad of a pogo stick in accordance with the principles of the present invention.

As shown in FIG. 4, the bottom 250 of the slider shaft 218 is provided with a bounce pad 238. The bounce pad assembly 238 consists of a metal bolt portion 252 with a large round head portion or insert 256. A urethane rubber pad 238 is bonded or mechanically attached to the insert 256. The threaded portion 252 of the bounce pad assembly 238 engages with internal threads 258 provided in a metal insert 260 attached to the distal end or bottom 250 of the slider shaft 218. The bounce pad 238 can then be attached to the slider shaft 218 by threading the bolt portion 252 into the insert 260. Furthermore, by making the bounce pad 238 detachable, it may be easily replaced if necessary as may be the case when the pad 238 becomes excessively worn.

The pad 238 softens the initial impact of the end of the slider shaft 218 with the ground to provide a smoother and less jarring ride for the user. In addition, the pad 238 provides a ground gripping structure like the tires on a car that allows the user to apply side forces to the pogo stick without the slider shaft 218 slipping from beneath the user. Thus, the pad 238 acts as both a cushion as the pogo stick hits the ground and a ground gripping member to allow the user to increase maneuverability of the pogo stick without losing control. This bounce pad 238 is long wearing and easily replaceable. Long wearing is an important trait because the pogo stick is designed to be used outdoors on surfaces that are very abrasive, such as concrete and asphalt. If the material used for the bounce pad 238 is too soft, it would wear away more quickly, requiring more frequent replacement. There is a tradeoff, however, in that the pad 238 should be soft enough to provide sufficient cushion for the user during use of the pogo stick. As such, there is some wear when the pad impacts and moves along the ground.

Figure 5A:
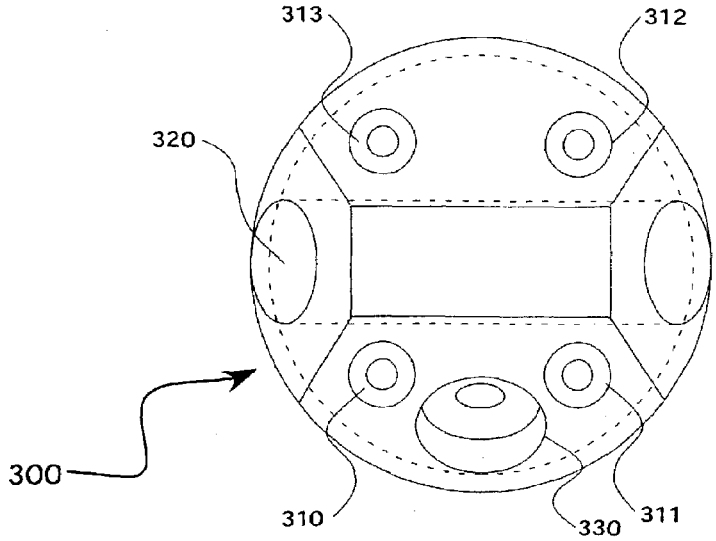
FIGS. 5A, 5B and 5C are top and side views, respectively, of a second embodiment of a top cap in accordance with the principles of the present invention.
Figure 5B:
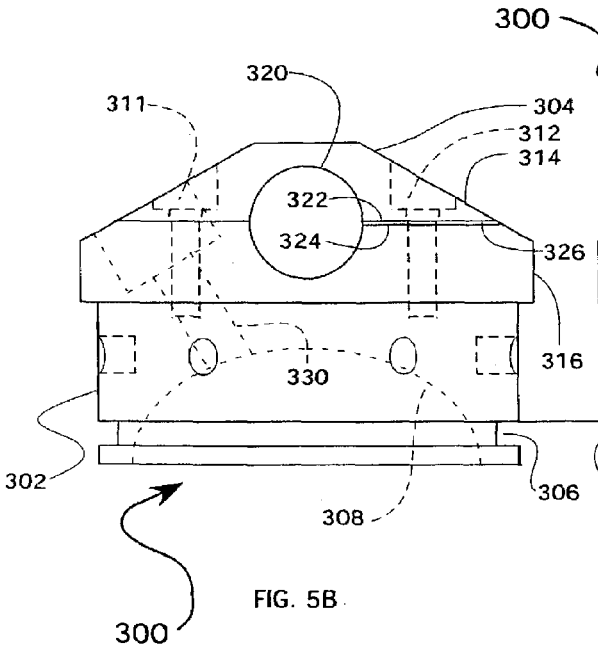
Figure 5C:
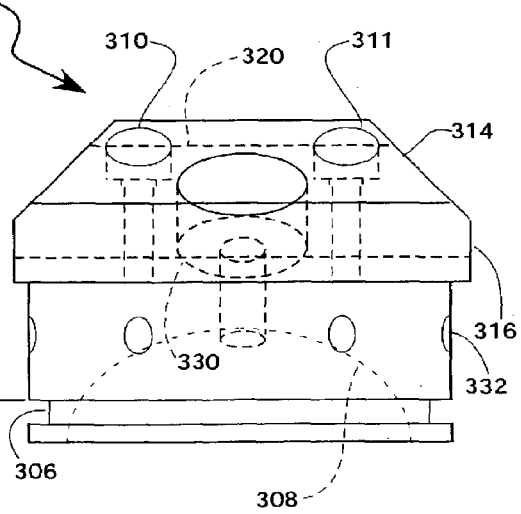

FIGS. 5A, 5B and 5C illustrate another embodiment of a top cap, generally indicated at 300 in accordance with the principles of the present invention. The top cap 300 is similar in configuration to the top cap illustrated in FIGS. 2A–2D, but is of a two piece construction. The top cap 300 includes an cylinder insertion section 302 and a handle bar clamping section 304. The insertion section 302 is a generally cylindrical member defining a circumscribing sealing groove 306 for receiving a sealing member. The bottom surface of the insertion section 302 defines the top of the cylinder and defines a semi-spherical recess 308. The clamping section 304 is attached to the insertion portion with a plurality of externally threaded fasteners or bolts that are threadedly inserted into threaded bores 310, 311, 312 and 313 that extend through the two sections 314 and 316 of the clamping section 304 and into the insertion portion 302.

The clamping section 304, defined by the two clamping members 314 and 316 define a transversely extending channel 320 for receiving the handle bars. The engaging surfaces between the members 314 and 316 abut one another along one side of the channel 320. On the other side of the channel, the engaging surfaces 322 and 324 define a gap therein between. As the bolts are tightened around the handle bars, this gap 326 will close to cause a clamping force around the handle bars.

A fill/bleed valve port 330 is in fluid communication with the surface 308 so as to be in fluid communication with the cylinder of the pogo stick. The use of two pieces as illustrated provides components that are easily machinable and easily assembled into the top cap 300 as illustrated. The insert section 302 is provided with a plurality radially spaced bores, such as bore 332 for receiving threaded fasteners therein and attaching the top cap 300 to the housing of the pogo stick of the present invention.

Figure 6A:
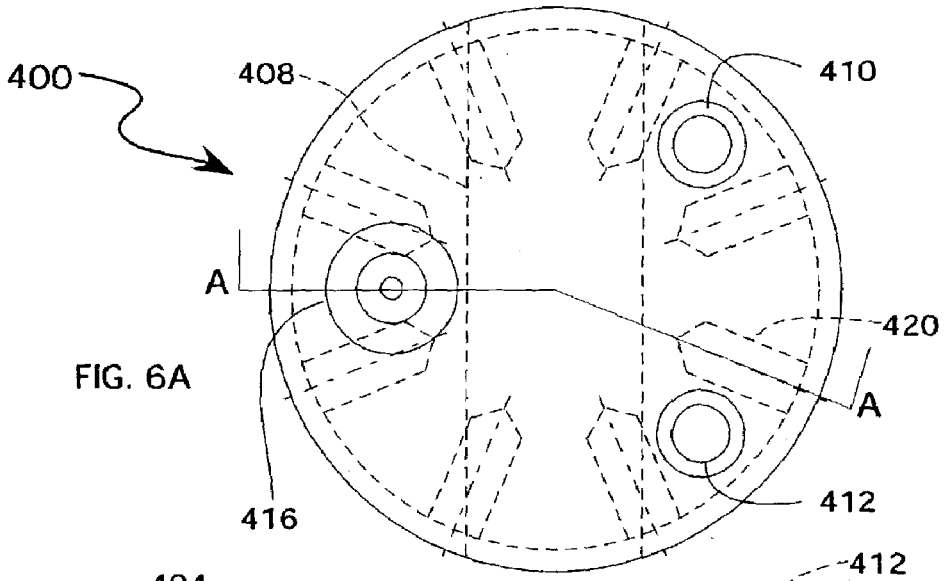
FIGS. 6A, 6B and 6C are top, side, and cross-sectional side views, respectively, of a third embodiment of a top cap in accordance with the principles of the present invention.
Figure 6B:
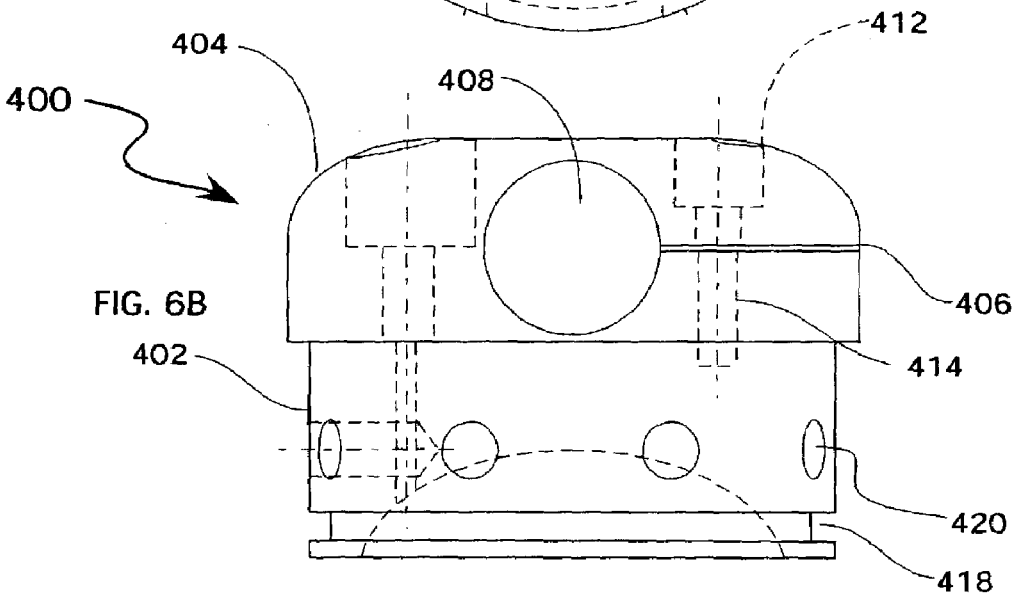
Figure 6C:
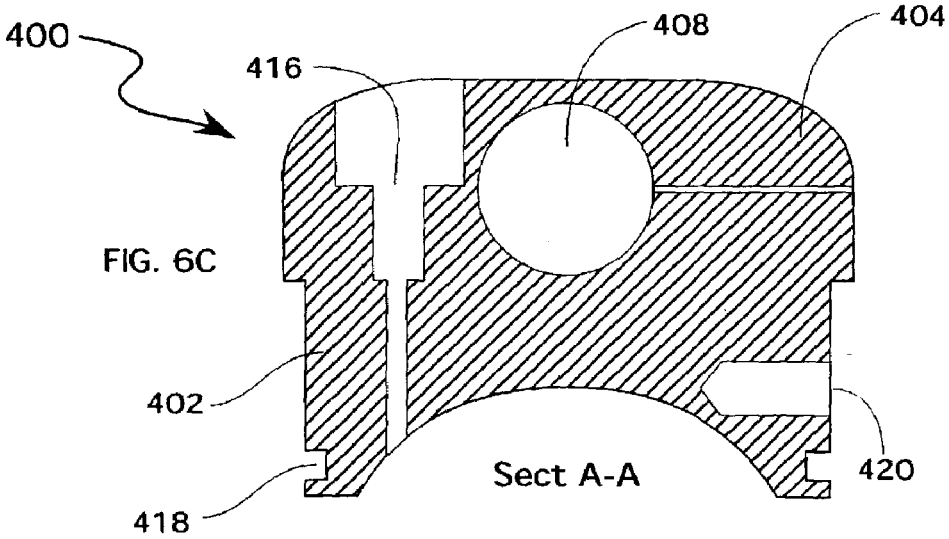

FIGS. 6A, 6B and 6C illustrate yet another embodiment of a top cap, generally indicated at 400 in accordance with the principles of the present invention. The top cap 400 is similar to the top cap of FIGS. 5A–5C, but is formed from a single, integral component. The top cap 400 includes an insertion portion 402 and a clamping portion 404. The clamping portion 404 defines a laterally extending gap 406 that is in communication with a transversely extending channel 408 for receiving handle bars. The gap 406 is closed with fasteners (not shown) that are inserted into bores 410 and 412 and engage with threaded bore 414. A port 416 is provided for receiving a schrader valve or other similar valves known in the art. An o-ring groove 418 is also provided for receiving a sealing member to seal the insert portion 402 to the housing of the pogo stick. A plurality of radially spaced internally threaded bores, such as bore 420 is also provided to attached the top cap 400 to the housing of the pogo stick.

Figure 7A:
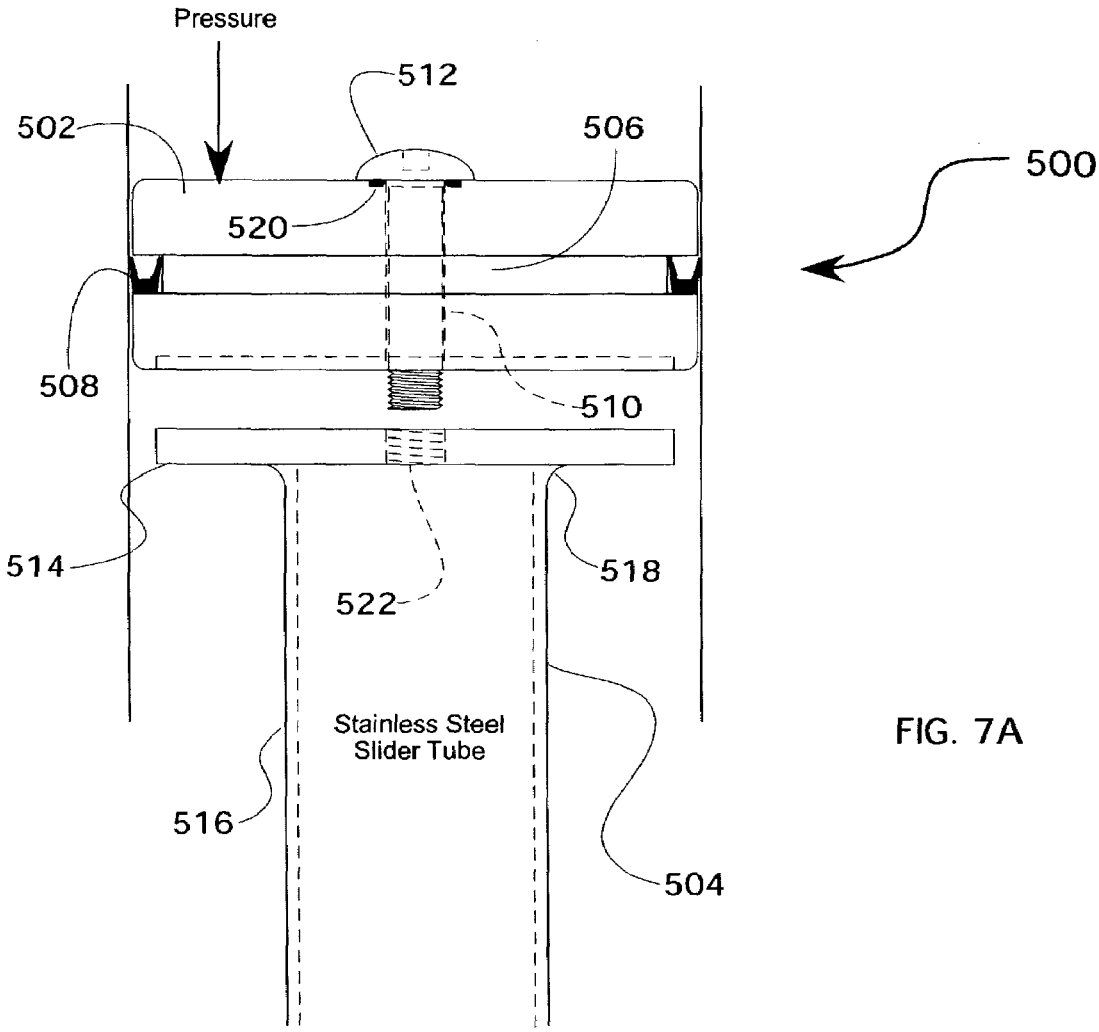
FIG. 7A is a partial cross-sectional side view of a second piston/shaft assembly in accordance with the principles of the present invention.
Figure 7B:
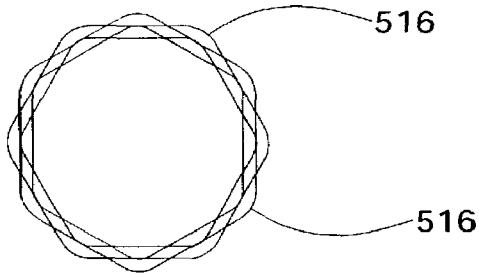
FIGS. 7B and 7C are cross-sectional views of a slider shaft in accordance with the principles of the present invention illustrating various geometries and orientations.
Figure 7C:
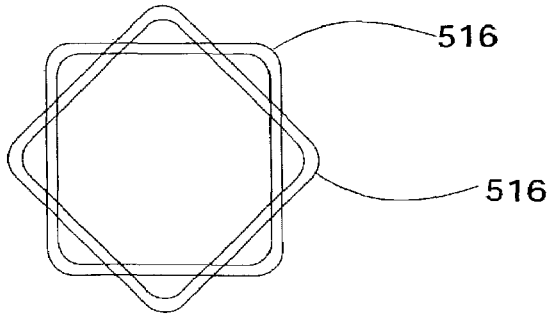

As shown in FIGS. 7A, 7B and 7C, a piston/shaft assembly, generally indicated at 500, in accordance with the principles of the-present invention, is comprised of a piston member 502 and a slider shaft assembly 504. The piston member 502 is comprised of a cylindrically shaped member, formed from a material such as ultra-high molecular weight polyethylene. A circumferential groove 506 for receiving a U-cup seal 508. A central bore 510 is configured for receiving a socket head cap bolt 512 to attach the shaft assembly 504 to the piston member 502.

The shaft assembly 504 is comprised of a circular or disk shaped plate portion 514 and a tube or shaft portion 516. The shaft portion 516 may be attached to the plate portion 514 as by welding with a weld 518. The plate portion 514 is center drilled and tapped to receive the bolt 512. An o-ring 520 may be placed on the bolt 512. The bolt 512 is then inserted through the piston portion 502 and threaded into the tapped hole 522. The bolt 512 holds the piston member 502 onto the plate 514 of the slider shaft 516. In addition, the use of a plate 514 to transfer the impact forces from the slider shaft 516 to the piston member 502 distributes such forces over a larger surface area of the bottom surface of the piston member 502 in increase the reliability of the piston member 502 and the life thereof.

As illustrated in FIGS. 7B and 7C, the cross-sectional configuration of the slider shaft 516 may be of a hexagonal shape as shown in FIG. 7B or a square shape as shown in FIG. 7C. In either case, the orientation of the shape may be positioned at various angles relative to the foot pedals of the device. It is further contemplated that other non-circular cross-sectional shapes, both symmetrical and asymmetrical may also be employed.

Figure 8A:
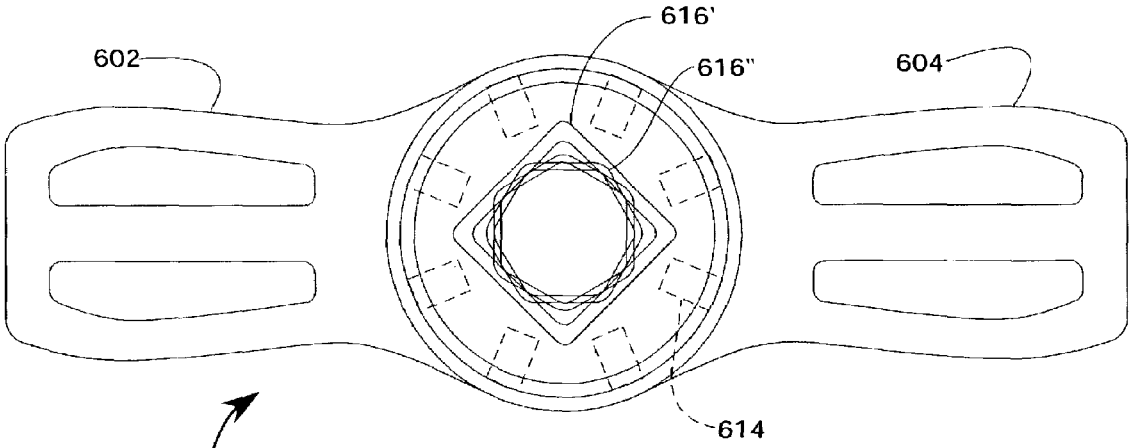
FIGS. 8A and 8B are top and side views of a second embodiment of a bottom bracket/foot support assembly in accordance with the principles of the present invention.
Figure 8B:
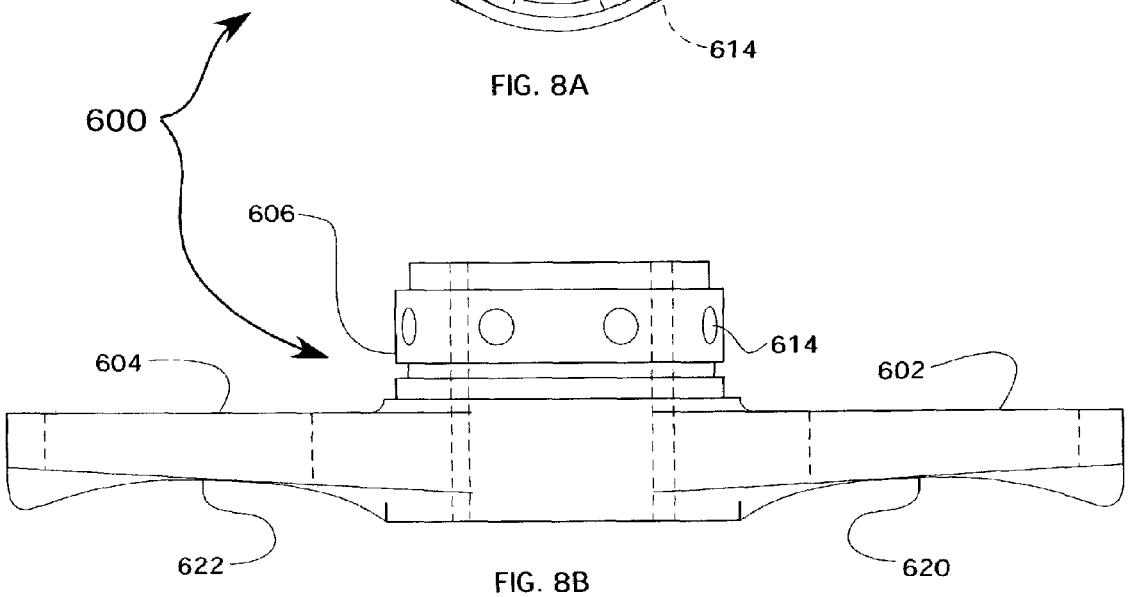

Referring now to FIGS. 8A and 8B, there is shown a foot pedal/bottom bracket assembly, generally indicated at 600, which may be formed from an integral piece of machined aluminum or cast or molded materials known in the art. The foot pedals 602 and 604 are thus integrally formed with the bottom bracket assembly 606. The bottom bracket assembly or portion 606 is configured similarly to other embodiments described herein and can be configured to accommodate a square slider shaft or a hexagonal slider shaft. The bracket assembly 606 is provided with a plurality of radially spaced bores, such as bore 614 for attaching the bottom bracket 606 to the housing of the pogo stick. A bushing 616' or 616" is coupled to the bracket assembly 606 so as to receive the slider shaft as discussed with reference to other embodiments herein, with the bushing 616' configured for receiving a square slider shaft and the bushing 616" configured for receiving a hexagonal slider shaft.

The foot pedals 602 and 604 are each provided with curved surfaces 620 and 622, respectively, on the bottoms thereof to provide the ability of the user riding the pogo stick to do various other extreme maneuvers, such as grinding and the like. Thus, the foot pedals of the present invention may include "grinding" features on their bottom sides. Such "grinder pedals" allow the user to do tricks that involve sliding on the pedals down various structures such as metal rails. Such pedals may also be formed from plastic with metal inserts on the bottom surface in order to decrease wear and friction when sliding.

Figure 9A:
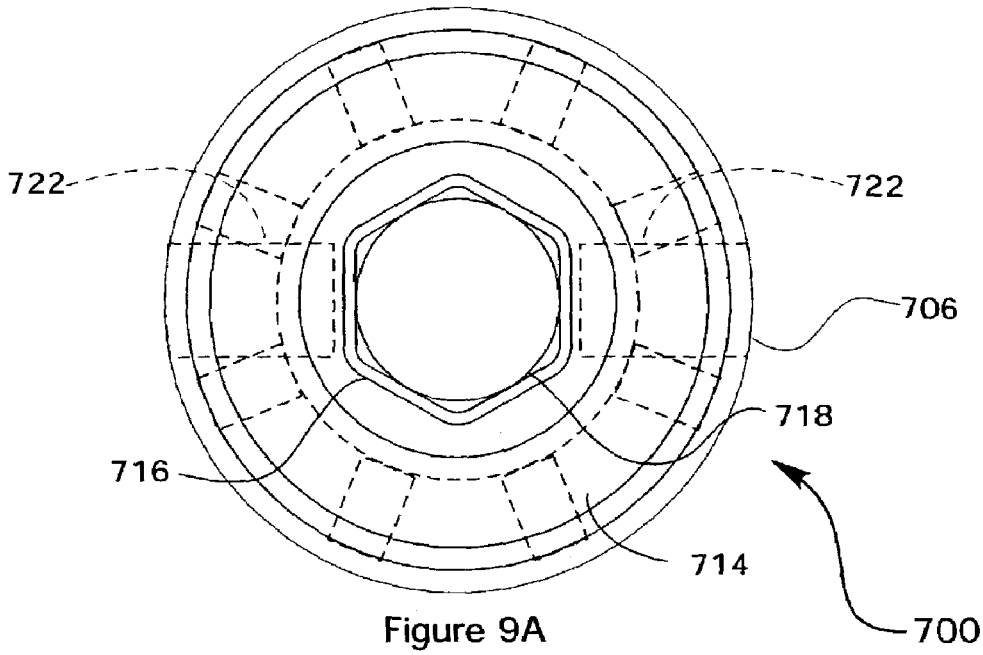
FIGS. 9A and 9B are top and cross-sectional side views of a third embodiment of a bottom bracket assembly in accordance with the principles of the present invention.
Figure 9B:
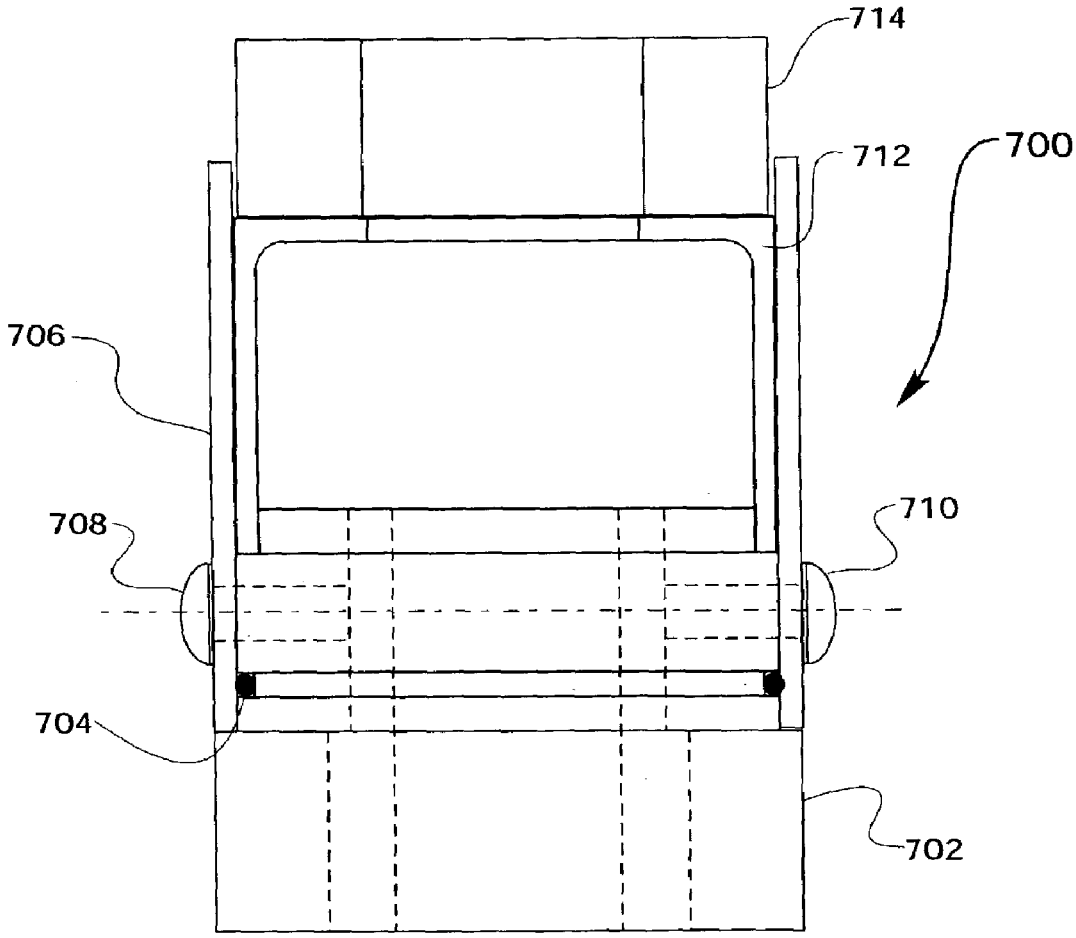

As shown in FIGS. 9A and 9B, a bottom bracket assembly, generally indicated at 700, for receiving a hex shaped slider tube is illustrated. The bottom bracket assembly 700 includes a bottom bracket 702 that is sealed with an o-ring 704 to the housing 706 and attached thereto with fasteners 708 and 710. The filter housing 712 is positioned on top of the bracket 702 and the resilient pad 714 is positioned above the filter housing 712. The slider shaft 716 fits within the bushing 718 and is prevented from rotation therewith. A pair of radially extending, internally threaded bores 720 and 722 are provided for attaching foot support members as previously described.

Hydraulic brakes may also be a feature of the pogo stick. Such brakes allow the user to stop the motion of the slider shaft by applying a clamping or gripping force to the slider shaft. In one embodiment, a lever, such as a brake lever found on a motorcycle is provided on the handlebars. The brakes, which may include brake pads or engaging members for grasping and holding the slider shaft, allow the user to prevent the slider shaft from moving relative to the cylinder such as when, for example, the slider shaft is not fully extended. The user can stop the motion of the pogo stick, rest for a moment, and then release the brake launching the user back into the air.

The pogo stick of the present invention has significantly more power than a conventional spring-type pogo stick, is more maneuverable, allowing the user to perform various tricks, and is durable and relatively light weight.

While the apparatus of the present invention has been described with reference to certain illustrative embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. For example, the top of the cylinder may be sealed off with a plastic cap that is attached to or integrally formed with the top portion of the housing. In addition, while it has been illustrated that a clamping device is secured to or integrated with the top cap for holding a pair of handle bars or gripping members to the top cap, the handle bars could be integrally formed with the top cap such that the top cap and handle bars are formed from a single injection molded piece.

It is also contemplated that a two piece aluminum clamp may be secured around the handle bars and then attached to the top cap. Likewise the handle bar clamping mechanism could be formed from other materials known in the art including polyethylene or polycarbonate. The claims provided herein are intended to cover such modifications and combinations and all equivalents thereof. Reference herein to specific details of the illustrated embodiments is by way of example and not by way of limitation.

What is claimed is:

1. A high performance pogo stick adapted for use by an adult user, comprising:

an elongate housing comprising a pneumatic cylinder, the housing having a proximal section and a distal section;

a handle mounted on the housing near the proximal section;

a foot support mounted on the housing near the distal section, the housing having a length configured such that the user can comfortably stand on the foot support and grasp the handle;

the cylinder constructed from lightweight, high strength material selected from the group comprising: PVC, polycarbonate, or cellulose acetate butyrate;

a piston slidable within the cylinder and having a proximal end and a distal end, the proximal end configured to form a substantially air tight chamber with said cylinder, said cylinder having an initial internal pressure;

a piston shaft coupled to the piston, the distal end of the piston shaft contacting the ground and configured to allow the user to bounce on the pogo stick;

the shaft and piston having a combined length which is less than that of the cylinder and configured such that when the piston is completely compressed within the cylinder by the user, a dead space is formed within the proximal section of said cylinder, the dead space containing only pressurized air and not occupied by said piston;

the length of the cylinder being in the range of about 2.5 to about 4.5 times that of the dead space; and an air release device mounted on the housing and configured to allow the user to adjust the internal pressure of the cylinder during use.

2. The pogo stick of claim 1 wherein the cylinder is formed by and integral with at least a portion of the housing.

3. The pogo stick of claim 1 wherein said housing is formed from an at least partially transparent plastic material to allow viewing of the piston therein.

4. The pogo stick of claim 1 wherein the length of the cylinder is about 3.25 times that of the dead space.

5. The pogo stick of claim 1 wherein the piston has a maximum stroke length of 18 inches and the dead space is eight inches in length when said piston is at the top of its maximum stroke.

6. The pogo stick of claim 1, wherein the cylinder includes at least one port for receiving a valve mechanism therein to allow pre-pressurization of the chamber.

7. The pogo stick of claim 1, wherein said cylinder is approximately two inches to four inches in diameter.

8. A high performance pogo stick, comprising:

an elongate pneumatic cylinder, the cylinder having a proximal section and a distal section;

a handle mounted on the cylinder near the proximal section;

a foot support mounted on the cylinder near the distal section, the cylinder having a length configured such that the user can comfortably stand on the foot support and grasp the handle;

the cylinder being constructed from lightweight, high strength material selected from the group comprising: PVC, polycarbonate, or cellulose acetate butyrate;

a piston slidable within the cylinder having a proximal end and a distal end, the proximal end configured to form a substantially air tight chamber with the cylinder; and a piston shaft coupled to the piston, the distal end of the piston shaft contacting the ground and configured to allow the user to bounce on the pogo stick;

the shaft and piston having a combined length which is less than that of the cylinder;

wherein the maximum compression ratio is about 2.5 to about 4.5.

9. The pogo stick of claim 8, further comprising a cylinder configured to allow the user to adjust the internal pressure cylinder during use.

10. The pogo stick of claim 8 wherein said cylinder is formed from an at least partially transparent plastic material.

11. A high performance pogo stick, comprising:

an elongate pneumatic cylinder;

a handle mounted on the pogo stick;

a foot support mounted on the pogo stick and separated from the handle such that a user can stand on the foot support and grasp the handle;

a piston slidable within the cylinder having a proximal end and a distal end; and a piston shaft coupled to the piston, the distal end of the piston shaft contacting the ground and configured to allow the user to bounce on the pogo stick;

the shaft and piston having a combined length which is less than that of the cylinder and configured such that when the piston is completely compressed within cylinder by the user, a dead space is formed within the proximal section of the cylinder the length of the cylinder being in the range of about 2.5 to about 4.5 times that of the dead space.

12. The pogo stick of claim 11 wherein the pogo stock further comprises an air release device mounted on the cylinder and configured to allow the user to adjust the internal pressure of the cylinder during use.

13. The pogo stick of claim 11 wherein said cylinder is formed from an at least partially transparent plastic material.

* * * * *

UNITED STATES PATENT AND TRADEMARK OFFICE

CERTIFICATE OF CORRECTION

PATENT NO. : 7,011,608 B2
APPLICATION NO. : 10/278075
DATED : March 14, 2006
INVENTOR(S) : Bruce L. Spencer It is certified that error appears in the above-identified patent and that said Letters Patent is hereby corrected as shown below:

At column 1, line 49, delete "provide" and insert -- provided --, therefor.

At column, 6, line 15, delete "invention." and insert -- invention; --, therefor.

At column 10, line 4, delete "low friction" and insert -- low-friction --, therefor.

At column 14, line 45, delete "an cylinder" and insert -- a cylinder --, therefor.

At column 15, line 23, delete "to attached" and insert -- to attach --, therefor.

At column 15, line 27, delete "the-present" and insert -- the present --, therefor.

At column 18, line 21, in Claim 8, after "cylinder;" insert -- and --.

At column 18, line 44, in Claim 11, before "the length" insert -- , --.

At column 18, line 47, in Claim 12, delete "stock" and insert -- stick --, therefor.

Signed and Sealed this

Twenty-ninth Day of May, 2007

JON W. DUDAS
*Director of the United States Patent and Trademark Office*